US005632920A

United States Patent [19]

Kim

[11] Patent Number: 5,632,920

[45] Date of Patent: May 27, 1997

[54] METHOD FOR CONTROLLING READ-TIME OF A HUMIDITY SENSOR IN A MICROWAVE OVEN

[75] Inventor: Seong J. Kim, Incheon, Rep. of Korea

[73] Assignee: Daewoo Electronics Co., Ltd., Seoul, Rep. of Korea

[21] Appl. No.: 515,966

[22] Filed: Aug. 16, 1995

[30] Foreign Application Priority Data

Aug. 16, 1994 [KR] Rep. of Korea ..... 1994-20168

[51] Int. Cl.[6] ..... H05B 6/80

[52] U.S. Cl. ..... 219/707; 219/702; 99/325

[58] Field of Search ..... 219/707, 702, 219/705, 712; 99/325; 73/29.01, 29.02, 335.02, 335.07

[56] References Cited

U.S. PATENT DOCUMENTS 4,518,839 5/1985 Taguchi et al. ..... 219/713
5,200,589 4/1993 Kim ..... 219/707
5,445,009 8/1995 Yang et al. ..... 73/29.01

FOREIGN PATENT DOCUMENTS 29 17 214 11/1979 Germany ..... 219/712

*Primary Examiner*—Philip H. Leung
*Attorney, Agent, or Firm*—Beveridge, DeGrandi, Weilacher & Young, L.L.P.

[57] ABSTRACT

Disclosed is a method capable of controlling read-time of a humidity sensor of a microwave oven so as to void interference by other parts in the microwave oven or exterior apparatuses, and thereby sensing an accurate humidity value in the microwave oven. In the method, one period of a frequency of an electric power is divided into a first section and a second section according to an outer interrupt signal. The humidities are sensed by predetermined times respectively in the first section and the second section, and then a noise count is increased in a corresponding section when a difference between a maximum value and a minimum value in each section is larger than a predetermined reference value. The obtained noise counts are compared, and then one section having less noise count is determined as a humidity sensing read time section.

4 Claims, 5 Drawing Sheets

METHOD FOR CONTROLLING READ-TIME OF A HUMIDITY SENSOR IN A MICROWAVE OVEN

BACKGROUND OF THE INVENTION

1. Field of the Invention

The present invention relates to a method for controlling read-time of a humidity sensor in a microwave oven, and more particularly to a method capable of controlling read-time of a humidity sensor in a microwave oven so as to avoid interference by other parts in the microwave oven, and thereby sensing an accurate humidity value in the microwave oven.

2. Description of the Prior Art

In general, automatic cooking methods used in the microwave oven are classified largely into a program type automatic cooking method and a sensor type automatic cooking method. According to the sensor type automatic cooking method, a humidity sensor and others in the microwave oven senses the humidity value of the moisture emitted from food put and heated in a heating chamber and other surrounding conditions such as temperature, and the cooking is controlled by automatic setting of the heating time according to the humidity sensing. Therefore, a great deal of research and development has been concentrated on the way to sense the humidity.

A conventional humidity sensing circuit used for a microwave oven as described above will be described hereinbelow with reference to the FIG. 1.

In FIG. 1, reference numerals 1, 2, 3 and 4 respectively designate a humidity sensing section for sensing humidity, an amplifying section for differentially amplifying the output of humidity sensing section 1, a microcomputer for outputting a control signal for controlling the humidity according to the amplified signal from amplifying section 2, and an equilibrium control section for controlling the equilibrium of humidity sensing section 1 according to the humidity control signal from microcomputer 3.

The humidity sensing circuit shown in FIG. 1 operates as follows.

At an initial stage of sensing the humidity, since an exact read-time for sensing humidity has not yet been set, microcomputer 3 sends an humidity control signal having a predetermined value through output terminals P0 through P4 and equilibrium control section 4 and thereby presets humidity sensing section 1.

Then, voltages of two nodes a and b of humidity sensing section 1 are inputted through non-inversion terminal and inversion terminal of an amplifier OP1 of amplifying section 2 and then are differentially amplified. The amplified voltages are inputted through an humidity value input terminal A/D on microcomputer 3. In this case, the inputted voltages corresponding to the humidity value have analog forms, and are inputted into an analog/digital converter in microcomputer 3 and then converted to digital values.

However, such values as above are different from the practical humidity value. It is because, in a microwave oven, food is heated by a microwave generated by a magnetron installed in the microwave oven so that leakage of the microwave, which necessarily happens in the course of heating the food, has an effect on the humidity sensing performed by humidity sensing section 1.

Hereinafter, more detailed description about the above-mentioned leakage of the microwave will be given with reference to FIG. 2 for showing a general control circuit of a microwave oven in relation to the operation as described above.

As shown in FIG. 2, the control circuit of the microwave oven comprises a low voltage transformer 11 and a high voltage transformer 12 for elevating the voltage of the inputted electric power to a predetermined value, an amplifying section 13 connected to high voltage transformer 12 so as to amplify the elevated voltage, a magnetron for generating a microwave utilizing the voltage amplified in amplifying section 13 as a driving power, a power supply section 15 for supplying an electric power into a control circuit board using the voltage received from low voltage transformer 11, an interrupt signal generating section 16 for generating an interrupt signal according to the power supply from power supply section 15, an humidity sensing section 17 for sensing the humidity and an amplifying section 18 for amplifying the sensed humidity value, and a microcomputer 19 for generally controlling various parts in microwave oven according to signals received from interrupt signal generating section 16 and amplifying section 18.

When the control circuit of microwave oven is operated, an input power of 110/220 V and 60 Hz is firstly applied to high voltage transformer 12 according to the control by door switch and relay switches for driving the magnetron which are not shown. Then, a voltage elevated to about 2000 V is applied from the second windings of high voltage transformer 12 to amplifying section 18 having a high voltage condenser H.V.C. and a high voltage diode H.V.D and then is doubled to about 4000 V. The doubled voltage is applied to magnetron 14 as a driving voltage so as to make magnetron 14 oscillate a microwave. At this time, since the electric current is interrupted during half-period due to the characteristic of the high voltage diode in amplifying section 18, an oscillation mode and a rest mode alternate corresponding to the frequency of the input power during the whole oscillation.

At the same time, the input power is supplied through low voltage transformer L.V.T. to power supply section 15 in the control circuit board, and power supply section 15 transform the input power into a direct current power and then supplies the direct current power to microcomputer 19, humidity sensing section 17, and other load driving relays. The power supplied to microcomputer 19 passes through interrupt signal generating section 16 which applies an outer interrupt signal as a pulse signal by a zero-crossing detection of frequency of an electric power of power supply section 15. Generally, interrupt signal generating section 16 is used in order for microcomputer 18 to determine whether the frequency of an electric power is a predetermined frequency such as 50 Hz or 60 Hz, or used for generating an interrupt signal for a specific object such as time-count, in a conventional control circuit of a microwave oven.

As described above, in the conventional control circuit of the microwave oven, there is a possibility that the microwave oscillated in magnetron 14 leak and flow through wires and nodes into the circuit and then function as noise to the sensed humidity value.

To overcome the above described problem, various methods for minimizing the leakage of microwave have been proposed. An example of the methods is shown in FIG. 1 in which a plurality of noise-absorbing condenser C1 through C4 are connected to humidity sensing section 1 and amplifying section 2 so as to reduce the effect of the leakage of microwave.

However, just installation as such can not entirely remove the effect of the leakage of microwave. On the contrary, the voltage charged in the condensers can have bad effect on the sensed humidity value so as to cause the value more inaccurate. Further, the condensers necessarily invite increase in the number of parts of the circuit so as to make the circuit be more complicated.

Meanwhile, there is another method in which the humidity values are sensed several times and then a mean value of the sensed humidity values is adopted as a resultant sensed humidity value. However, neither this method can entirely remove bad effect by the leakage of microwave.

Furthermore, still another method for overcoming the above problems has been proposed. In the method, an attention wad paid on that, in a humidity sensing circuit, a voltage elevated up to about 2000 V through a high voltage transformer is doubled to about 4000 V by an amplifying section having a high voltage condenser and a high voltage diode and then is applied to a magnetron as a main driving voltage of the magnetron, and that an oscillation mode and a rest mode alternate corresponding to the frequency of input power such as 50 Hz or 60 Hz during the whole oscillation of the magnetron since the input power is interrupted during half-period thereof due to the characteristic of the high voltage diode in the amplifying section. Therefore, the humidity value can be read without hindrance by the leakage of microwave in the rest mode at which the oscillation of microwave by the magnetron is instantly interrupted.

In the meantime, in an actual assembling process of a microwave oven, electric wires in the microwave oven are discriminated only by colors of black and white wherein the black and white wires respectively have corresponding black and white electric terminals. When the black and the white wires are connected to their corresponding correct terminals, the electric phases of the part in the microwave oven are coincide with their own phases.

However, though the wires are not connected to their corresponding correct terminals, the operation of all parts can be normal, and thereby wrong winding can be happened in the course of manufacturing the microwave oven and it is not easy to find the wrong winding after manufacture of the microwave oven.

Therefore, if the phase of the electric power is inverted due to the wrong winding when the humidity value is sensed in the microwave-rest mode by the above method, the humidity is sensed in other section at which sensing the humidity is effected by the leakage of microwave and thereby a contrary effect is resulted.

SUMMARY OF THE INVENTION

The present invention is intended to overcome the above-discussed and numerous other disadvantages and deficiencies of the prior art.

Therefore, it is an object of the present invention to provide a method for controlling read-time of an humidity sensor of a microwave oven by which a microwave-rest section can be accurately detected regardless of winding errors or phase errors of wires.

To achieve the above object, the present invention provides a method for controlling read-time of a humidity sensor of a microwave oven for cooking food using an oscillation of a magnetron, the method comprising the steps of:

(a) dividing one period of a frequency of an electric power into a first section and a second section according to an outer interrupt signal;

(b) sensing humidities by predetermined times respectively in the first section and the second section, and then increasing a noise count in a corresponding section when a difference between a maximum value and a minimum value in each section is larger than a predetermined reference value; and (c) comparing noise counts obtained in step (b) with each other, and then determining one of the first and the second sections as a humidity sensing read time section, said one section having less noise count.

BRIEF DESCRIPTION OF THE DRAWINGS

The above objects and other advantages of the present invention will become more apparent by describing in detail a preferred embodiment thereof with reference to the attached drawings in which.

DETAILED DESCRIPTION OF THE PREFERRED EMBODIMENTS

Hereinafter, a method for controlling read-time of an humidity sensor of a microwave oven according to the present invention will be described in detail with reference to the accompanying drawings.

Figure 1:
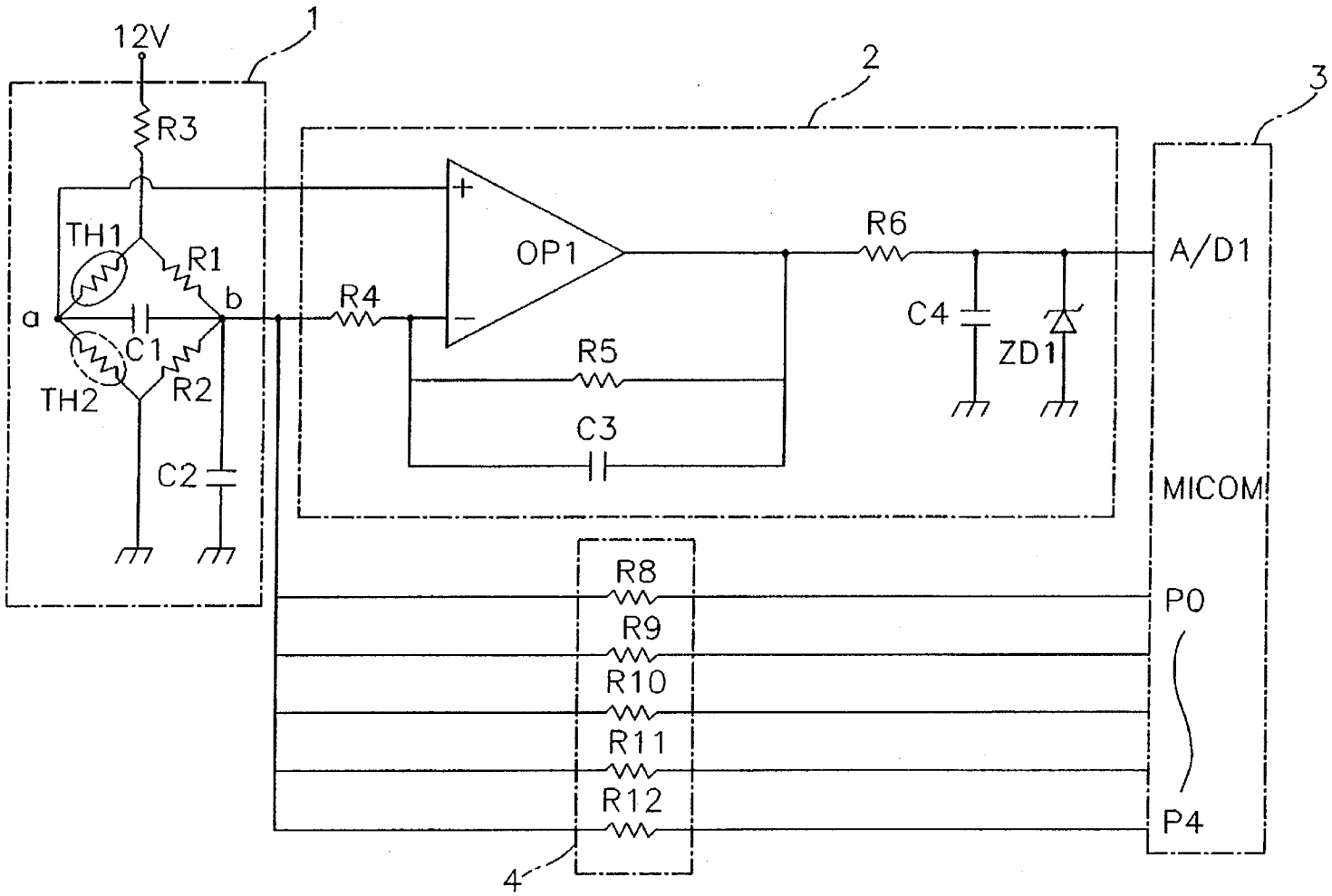
FIG. 1 PRIOR ART
FIG. 1 is of a conventional humidity sensing circuit diagram of the microwave oven.
Figure 2:
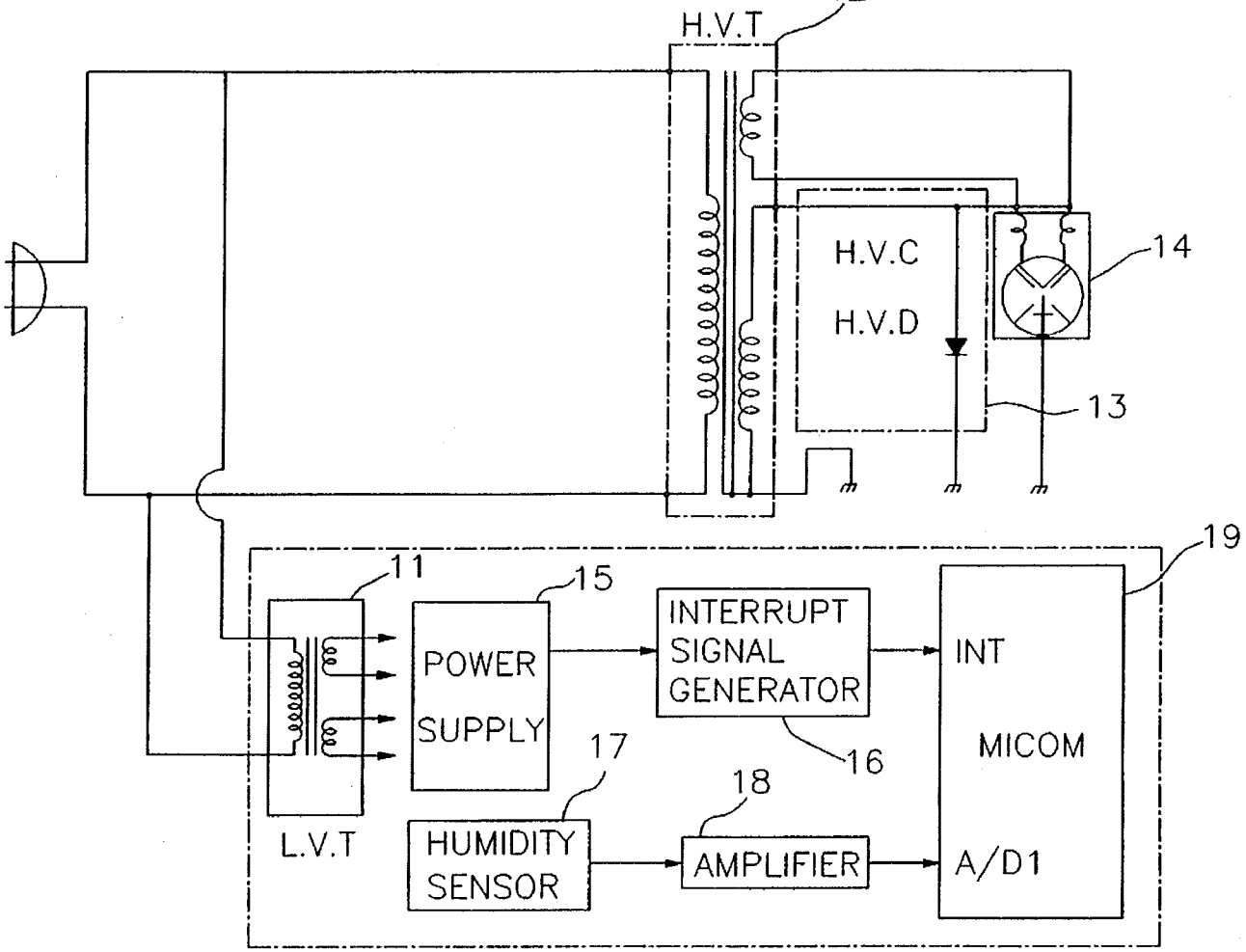
FIG.2 PRIOR ART
FIG. 2 is a general control circuit diagram of a microwave oven.
Figure 3A:
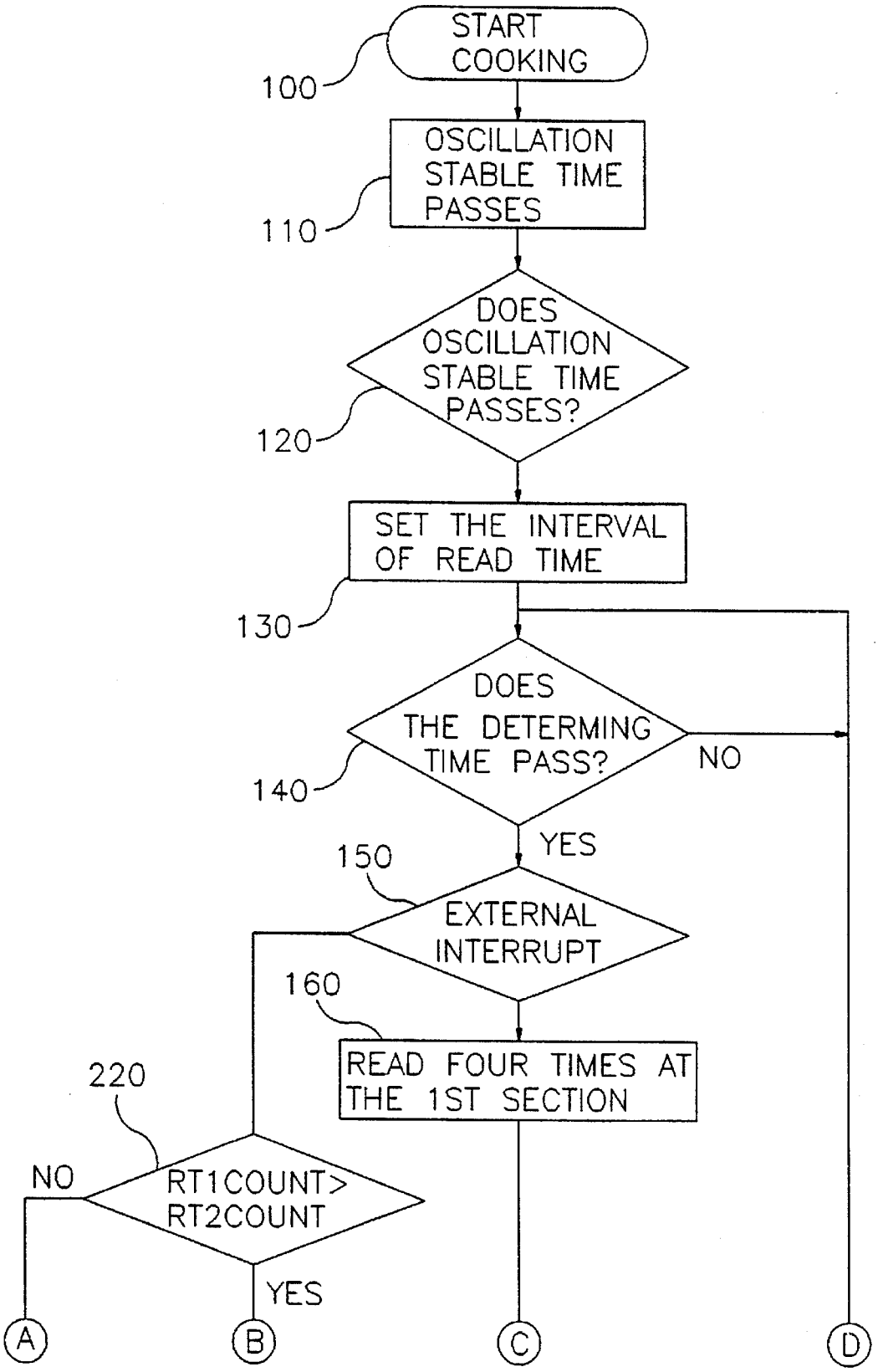
FIGS. 3A and 3B are flow charts for determining the read-time of an humidity sensor of a microwave oven according to the present invention.
Figure 3B:
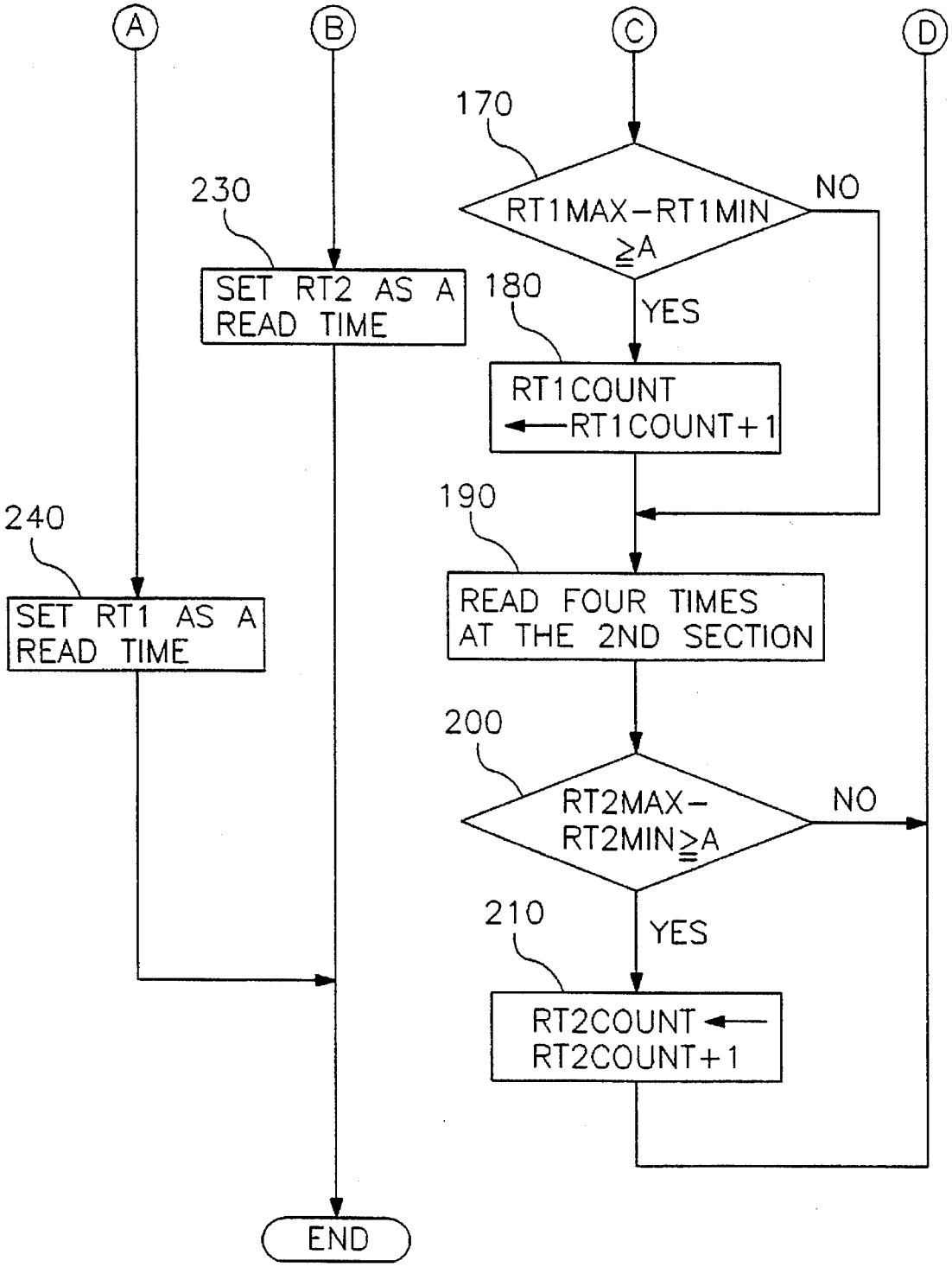

Referring to FIGS. 3A and 3B showing flow charts for determining the read-time of an humidity sensor of a microwave oven according to the present invention, a description will be given hereinbelow.

Firstly, cooking of food in the microwave oven is started according to conditions set by a user (step 100). After the cooking is started, a predetermined time for stabilizing the oscillation of the magnetron (about 1–2 seconds) is waited for (step 110).

The microcomputer checks whether the stabilizing time has passed at every predetermined time interval (step 120), and it proceeds to step 130 when the stabilizing time has passed.

Figures 4A, 4B:
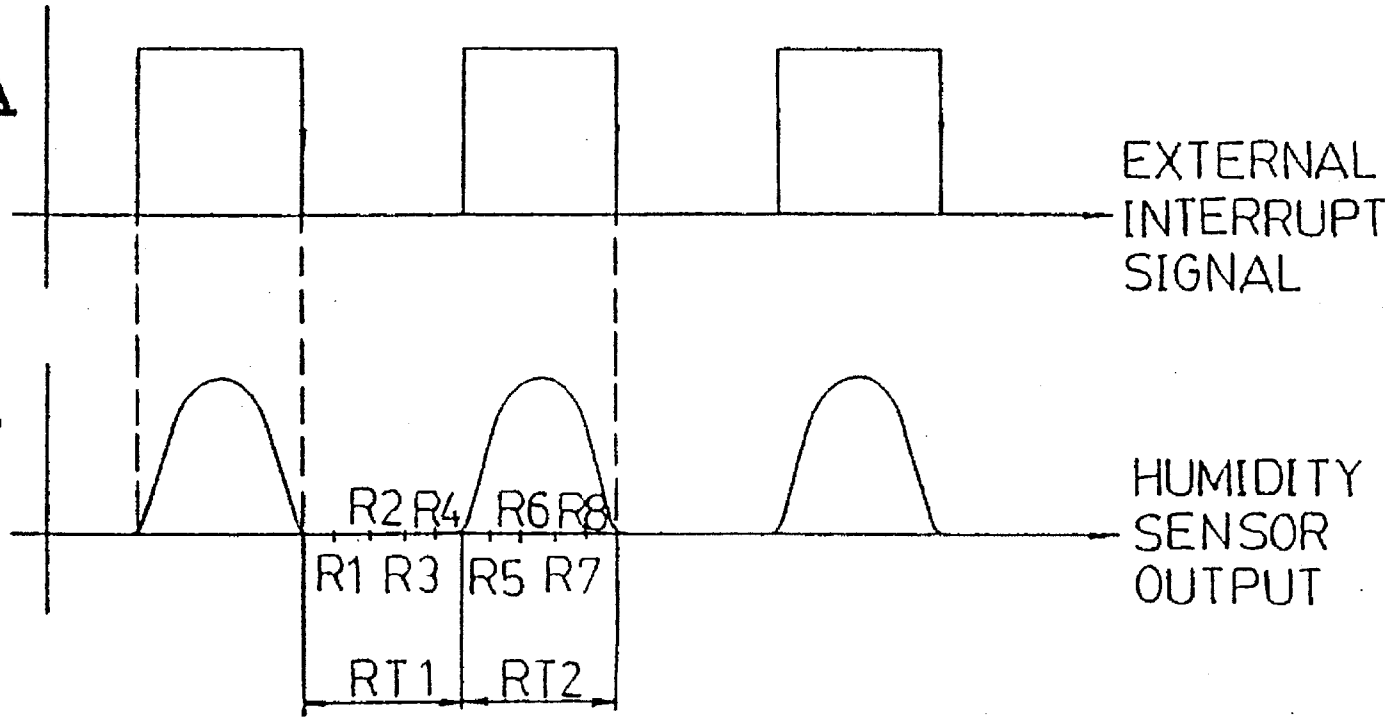
FIGS. 4A and 4B respectively are waveform charts of an outer interrupt signal and an output of a humidity sensor.

In step 130, as shown in FIG. 4B, an outer interrupt signal generated by one time at every one period of a frequency of an electric power is divided into two half-periods of time as a first section RT1 and a second section RT2.

In step 140, it is continually sensed whether the outer interrupt signal according to the frequency of the electric power is generated. When the outer interrupt signal is generated, it proceeds to step 150. In this case, as shown in FIG. 4A, the outer interrupt signal is a pulse signal the edge of which is the zero-crossing point of the input power, and the lowering edge is recognized as the interrupt.

In step 150, it is decided whether a predetermined read time determining time, which corresponds to about 10 seconds after the stabilization of the oscillation, has passed.

When the predetermined read time determining time has not yet been passed, the humidity sensing value is read by a predetermined times, such as four times, at regular intervals during the first section (step 160).

A maximum value $RT1_{max}$ and a minimum value $RT1_{min}$ are found out among the values read in step 160, and it is decided whether the difference between the maximum value $RT1_{max}$ and the minimum value $RT1_{min}$ is larger than a predetermined noise-determining reference value A (step 170), a noise count in the first section is added one by one when the difference is larger than the value A (step 180).

Also, by the same way, the humidity sensing value is read by a predetermined times, such as four times, at regular intervals during the second section (step 190). A maximum value $RT2_{max}$ and a minimum value $RT2_{min}$ are found out among the values read in the second section at step 190, and it is decided whether the difference between the maximum value $RT2_{max}$ and the minimum value $RT2_{min}$ is larger than the predetermined noise-determining reference value A (step 200), a noise count in the second section is added one by one when the difference is larger than the value A (step 210).

Steps 140 through 210, at which an outer interrupt signal generated by one time at every one period of a frequency of an electric power is divided into two half-periods of time and the noise count is added according to the difference between the maximum and the minimum values in each section, are repeated according to the above described process.

In the course of the above repetition, if the read time determining time has passed, the noise count value $RT1_{count}$ in the first section RT1 and the noise count value $RT2_{count}$ in the second section RT2 compared with each other (step 220).

As a result of the comparison, if the noise count value $RT1_{count}$ in the first section RT1 is larger than the noise count value $RT2_{count}$ in the second section RT2, it is interpreted that the leakage of microwave is happened and thereby noise generated in the first section. Therefore, the second section RT2 is determined as the humidity sensing read time (step 230).

On the contrary, if the noise count value $RT2_{count}$ in the second section RT2 is larger than the noise count value $RT1_{count}$ in the first section RT1, it is interpreted that the leakage of microwave is happened and thereby noise generated in the second section. Therefore, the first section RT1 is determined as the humidity sensing read time (step 240).

Therefore, the rest section in which no microwave is oscillated is accurately found out by determining a half-period of a frequency of an electric power with less noise as the read time, and then the humidity is sensed by reading the humidity sensing value in the read time section decided as above according to the outer interrupt signal after the preset is completed.

As described above in detail, according to the present invention, a noise section and a read time section are decided based on the noise-generating frequency, and the humidity sensing value is read only in the read time section. Accordingly, the humidity value can be sensed without being influenced by the leakage of microwave, so that the accuracy in sensing the humidity. Further, variance in cooking performance is reduced, so that the reliability on the microwave oven is elevated.

While the present invention has been particularly shown and described with reference to a particular embodiment thereof, it will be understood by those skilled in the art that various changes in form and details may be effected therein without departing from the spirit and scope of the invention as defined by the appended claims.

What is claimed is:

1. A method of controlling read-time of humidity sensor of a microwave oven for cooking food using an oscillation of a magnetron, the method comprising the steps of:

(a) dividing one period of a frequency of a power source of the microwave oven into a first section and a second section according to an external interrupt signal generated in a zero-crossing point of a frequency signal of the power source, the first section and the second section having the same period;

(b) sensing humidities repeatedly and respectively in the first section and the second section, and then increasing a noise count in the first section and the second section when a difference between a maximum value and a minimum value in each section is larger than a predetermined reference value; and (c) comparing noise counts obtained in step (b) with each other, and then determining one of the first and the second sections as a humidity sensing read time section when the count of said one section has less noise count than that of other section.

2. The method as claimed in claim 1, wherein the step (b) is repeated until a predetermined determining time has passed.

3. The method as claimed in claim 1, wherein the setting of the real-time is accomplished at rest sections at which the oscillation of the magnetron is instantaneously interrupted.

4. The method as claimed in claim 1, wherein the step (a) further comprises a step of waiting for a predetermined oscillation-securing time, and the setting of the read time is accomplished after the waiting step.

* * * * *